US006602055B1

(12) United States Patent
Thurot et al.

(10) Patent No.: US 6,602,055 B1
(45) Date of Patent: Aug. 5, 2003

(54) LEACHATE AND DEPOLLUTION PNEUMATIC PUMP WITH SLEEVE VALVE

(75) Inventors: Philippe Thurot, Saintry sur Seine (FR); Jean-François Ranson, Fouquieres les Lens (FR)

(73) Assignee: Audit, Conseil, Efficacite, Strategie, Environnement & Developpement, Saintry sur Seine (FR)

( * ) Notice: Subject to any disclaimer, the term of this patent is extended or adjusted under 35 U.S.C. 154(b) by 0 days.

(21) Appl. No.: 09/857,620

(22) PCT Filed: Dec. 6, 1999

(86) PCT No.: PCT/FR99/03026

§ 371 (c)(1),
(2), (4) Date: Nov. 30, 2001

(87) PCT Pub. No.: WO00/34657

PCT Pub. Date: Jun. 15, 2000

(30) Foreign Application Priority Data

Dec. 7, 1998 (FR) ..... 98 15389

(51) Int. Cl.[7] ..... F04F 1/06; F04F 3/00

(52) U.S. Cl. ..... 417/118; 417/137; 251/5; 251/61

(58) Field of Search ..... 417/137, 138, 417/145, 118; 251/5, 61

(56) References Cited

U.S. PATENT DOCUMENTS

| | | | | | |
|---|---|---|---|---|---|
| 2,486,617 | A | | 11/1949 | Soberg | 103/44 |
| 4,021,147 | A | * | 5/1977 | Brekke | 417/138 |
| 4,701,107 | A | * | 10/1987 | Dickinson et al. | 417/86 |
| 4,704,071 | A | * | 11/1987 | McCullough | 417/85 |
| 4,802,829 | A | * | 2/1989 | Miller | 417/12 |
| 5,006,046 | A | * | 4/1991 | Buckman et al. | 417/54 |
| 5,186,611 | A | * | 2/1993 | Frandsen | 417/138 |
| 5,411,381 | A | | 5/1995 | Perrodin | 417/472 |
| 5,451,144 | A | * | 9/1995 | French | 417/131 |
| 6,224,343 | B1 | * | 5/2001 | Newcomer | 417/118 |
| 6,234,761 | B1 | * | 5/2001 | Kocsis et al. | 417/118 |
| 6,352,109 | B1 | * | 3/2002 | Buckman, Sr. | 166/250.03 |

FOREIGN PATENT DOCUMENTS

| | | |
|---|---|---|
| CH | 579 220 | 8/1976 |
| FR | 716.940 | 12/1931 |
| FR | 1.124.528 | 10/1956 |
| GB | 1082014 | 9/1967 |

* cited by examiner

*Primary Examiner*—Charles G. Freay
*Assistant Examiner*—William H. Rodriguez
(74) *Attorney, Agent, or Firm*—Young & Thompson

(57) ABSTRACT

A pneumatic pumping device for pumping liquids such as landfill leachates and polluted liquids or thick matter includes a tubular body (1) forming a pump body and defining a cylindrical main chamber (2) in the upstream and downstream ends of which respectively emerge an inlet (3) and outlet (4) for the liquid to be pumped. The pneumatic device further includes a sleeve valve (7) arranged in front of the inlet to control the passage of the liquid to be pumped through the orifice, elements (8) for controlling the opening and closure of the sleeve valve with a compressed gas, a delivery pipe (9) passing through the outlet and extending inside the tubular body over the major part of the length thereof, and elements for supplying the main chamber with compressed gas.

10 Claims, 4 Drawing Sheets

LEACHATE AND DEPOLLUTION PNEUMATIC PUMP WITH SLEEVE VALVE

FIELD OF THE INVENTION

Figure 1:
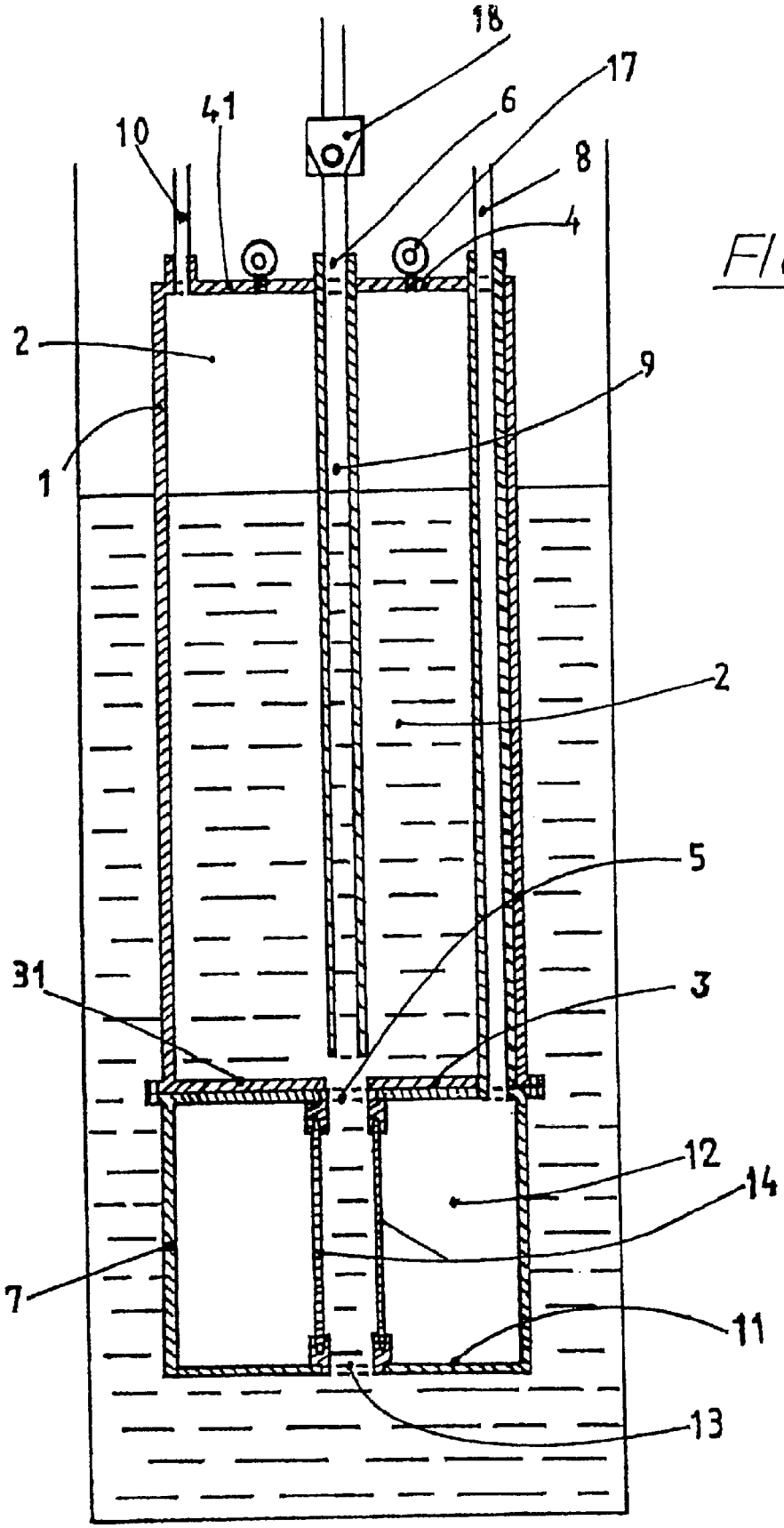

The invention concerns a pneumatic pumping device for pumping liquid.

The invention concerns more especially a pneumatic pumping device operating in a discontinuous fashion and with compressed gas such as air, and that is intended for pumping all sorts of liquids and more especially, but not exclusively, liquids such as landfill leachates, thick matter or polluted and possibly thick liquids. Within the framework of this invention, the term 'liquid' designates all these liquids indifferently.

The pneumatic pumping device of the invention is intended for working in an immersed position and for pumping up leachates and other liquids, regardless whether they are polluted and/or thick or not, from depths in the order of 50 to 60 meters. Such liquids may have a high temperature, for example in the order of 80° C. Moreover, these liquids can be loaded with salt and transport abrasive particles such as sand, clayey smalls or sandy muds.

Most pumps existing on the market exhibit numerous shortcomings when they should be used for pumping leachates or polluted and/or thick liquids.

Indeed, engine pumps are not often explosion-proof since they operate directly on electricity; and all the known pneumatic pumps, which are explosion-proof since they are supplied with the energy produced by compressed air, comprise strainers, shutters or floaters that can be clogged or blocked regularly by the presence of mud or sludge at the bottom of the liquid pumping up wells, and by the presence of chloride deposits. Moreover, the presence of a floater or of a shutter can limit the positioning possibilities of the pump.

These problems lead to high maintenance and upkeep costs of the pumps, as well as repeated handling of the materials in spite of the toxicity risks associated with certain pumped products.

Moreover, for certain pneumatic pumps, devices associated with a floater are suggested, which trigger the air supply into the pump directly. The purpose of these pumps is to be able to control the operation of the pump directly, in relation to the arrival and to the level of the liquid. However, when the floater is blocked, the pump is not operating any longer and the pump operator cannot know whether the said pump is working, not working, or off.

Another shortcoming is the very large number of maintenance parts.

Also, in most landfills the permanent problem is the presence of plastic films floating on the surface in the leachates, which leads regularly to clogging and stopping the operation of the pumps.

Besides, it may be interesting for the landfill operator to regulate the operation of the pump according to the level of leachates or polluted liquids in the well, without running the risk of causing an explosion, for example by a spark. Indeed, the landfill wells have often now a double mission to fulfil: to enable pumping up leachates and pumping biogases.

The purpose of the invention is to provide a pneumatic pumping device that is capable of remedying the shortcomings mentioned above and that can be placed easily in a well or a pit at variable depths.

The purpose of the invention is satisfied with a pneumatic pumping device of a liquid operating in a discontinuous fashion and immersed, and with compressed gas and that is intended for pumping liquids such as landfill leachates. This device comprises a tubular body forming a pump body and defining a cylindrical main chamber in the upstream and downstream ends of which respectively emerge an inlet orifice and an outlet orifice for the liquid to be pumped.

According to the invention, the pneumatic device comprises a sleeve valve arranged in front of the inlet orifice to control the passage of the liquid to be pumped through the said orifice, means for controlling the opening and closure of the sleeve valve with a compressed gas, a delivery pipe passing through the outlet orifice and extending inside the tubular body over the major part of the length thereof, and means for supplying the main chamber with compressed gas.

The invention also concerns the following features, considered individually or in all their technically possible combinations:

The pumping device can be used in vertical position as well as in horizontal or slanted position.

This advantage is due to the fact that the device does not comprise any shutters or floaters.

The tubular body forming a pump body consists essentially of a cylindrical tube closed at both its ends, the upstream end and the downstream end, respectively with a lower plate and an upper plate, whereas the space between both these plates forms the main chamber of the pumping device, the inlet orifice of the main chamber is placed in the lower section of the tubular body, considered in the position of use of the device according to the invention and the outlet orifice is arranged in the upper section of the tubular body.

Advantageously, in view of the cylindrical shape of the tubular body as well as of the main chamber, the inlet orifice of the main chamber is situated in the lower plate of the tubular body and the outlet orifice is situated in the upper plate.

The pump body has a cylindrical revolution.

The sleeve valve is composed of a tubular body forming a secondary chamber in the upstream and downstream ends of which emerge, at each of both ends, at least one opening for the passage of the liquid to be pumped. These passage openings are connected together by an elastically ductile sleeve that constitutes a channel through the liquid to be pumped should flow to enter the main chamber of the pumping device. The sleeve separates hermetically the channel from the secondary chamber surrounding the channel.

The tubular body of the pump, the plates and the sleeve valve are made of materials resistant to thick matters, polluted liquids, salted liquids and liquids whose temperatures may be higher than 80° C.

The pump body can be made of a material selected among the group constituted by iron, stainless steel, coated iron, elastomers, glass and carbon fibre materials, materials resisting to very high temperatures and to pressure, coated materials and alloys.

The material of the tubular body of the pump is selected so that the body can be protected by an anticorrosion coating, preventing oxidations and chloride deposits.

The sleeve valve is arranged outside, and adjacent to, the tubular body in front of the inlet orifice, and the sleeve is advantageously arranged coaxially with respect to the axis of the inlet orifice. However, the sleeve can also be offset radially. The liquid to be pumped cannot reach the main chamber as long as the sleeve valve is closed.

The inlet orifice of the main chamber and the sleeve of the sleeve valve are arranged coaxially with respect to the axis of the tubular body.

In order to control the passage of the liquid to be pumped through the inlet orifice, the space surrounding the passage channel of the sleeve valve is connected by a pipe integral with the tubular body, to a compressed gas supply source. This arrangement enables to control the closure of the sleeve valve by injecting a compressed gas in the space of the secondary chamber surrounding the channel and to choke the sleeve.

The delivery pipe going through the outlet orifice extends outside the main chamber over a distance enabling to connect the delivery pipe to a duct linking the pumping device to a collector intended for receiving the liquid to be pumped.

The delivery pipe is fitted with a return valve.

The delivery pipe extends inside the main chamber almost up the lower plate. The distance between the free end of the delivery pipe and the lower plate delineates the volume or the quantity, of liquid that remains in the main chamber at the end of the exhaust phase. A judicious selection of this distance enables total emptying of the main chamber.

The means enabling to supply the main chamber with compressed gas are advantageously composed of an opening provided in the upper plate of the tubular body, whereas the opening enables connection of the main chamber, for example by a pipe going through the upper plate of the tubular body and by any other appropriate means, to a compressed gas supply source.

At least one of the pipes among the delivery pipe, the compressed gas supply pipe of the main chamber and the compressed gas supply pipe of the secondary chamber, does not protrude from the wall of the pump body. Connection to the pipe(s) concerned is made, for example, by screw coupling(s).

The pumping device is fitted with at least one eyelet for fixing a chain, a cable or a film enabling to lower the device into a well, to fasten it and to maintain it at a determined (depth) level, to lift it and to winch it from the well. Most often, the pumping device will be provided with two eyelets, but it may obviously be fitted with more than two eyelets.

The pumping device is fitted with a protection grid or a strainer enabling to protect the sleeve valve against loads whose sizes exceed a selected limit value. This limit value or maximum template is defined advantageously by the mesh size of the grid.

The pumping system is fitted with a tripod integral with the pump body or a tripod screwed or welded to, for example by means of a foundation circular base, the pump body.

Both pipes used for connection of the compressed air supply of the pump body and of the sleeve valve, and possibly the delivery pipe as well, protrude from the pump body. In this embodiment, the connection of each of these pipes to corresponding pipes from the surface of the well or the pit, is made for example by a screw coupling, at a given distance from the upper plate of the pump body. Thanks to this arrangement, the operator has a better grip on the pump when inserting it into the well or the pit.

The pneumatic pumping device, called thereunder 'the pump' as well, is designed to operate in an immersed fashion. So, the arrangement of the delivery pipe in the upper plate of the tubular body is advantageous since the liquid to be pumped can be emptied by a straight pipe. However, any arrangement different from the said, for instance the connection of a bent pipe to the lateral wall of the tubular body, also corresponds to the principle of this invention.

The pump operates as follows:

The secondary chamber of the sleeve valve is depressurised. Thus, the sleeve expands, the sleeve valve opens and the liquid to be pumped enters the main chamber of the pump immersed.

The level of liquid inside the pump and outside, i.e. in the well, are balanced according to the principle of communicating vessels.

When the main chamber is full, delay means ('timer') actuate a device for controlling the sleeve valve and pressurise the said valve. Compressed air is then set in communication with the secondary chamber of the sleeve valve, which means that the pressure of the compressed air pushed the ductile sleeve back until it is choked so that the inlet orifice of the main chamber is blanked off, to prevent all liquids and sludges from entering or leaving the pump body, which isolates the liquids and sludges from the external medium of the well, in the pump body.

After a period given by the delay means, seeing to the closure of the sleeve of the valve and maintaining it in closed position, compressed air is sent to the main chamber of the body of the pump. This compressed air inrush expels the leachates and the liquids contained in the pump body, through the delivery pipe towards the surface of the well and into a collector, a tank or any other appropriate means available for receiving the pumped liquid.

When the main chamber and the delivery pipe are purged from all liquids, the sleeve valve control means depressurised the secondary chamber, which enables, on the one hand, to sleeve to expand and to release the inlet orifice of the main chamber and, in so doing, on the other hand, the pumping device to wrap around to the beginning of the cycle.

For good operation of the pump, a number of conditions must be met advantageously:

The sleeve valve is installed in the extension of the main chamber. Advantageously, the tubular body constitutes at the same time the external wall of the main chamber and that of the secondary chamber. In such an arrangement, the lower plate separates both chambers hermetically.

The passage opening of the valve is situated at a level above which the landfill or the pumping up well of polluted liquids should be emptied imperatively.

Filling the pump with compressed air is made through the upper section of the pump body in order to prevent the formation of air bubbles in the liquid.

The ductile sleeve is a material resistant to abrasion and temperatures in the order of 80° C. and may also be resistant to different types of polluted liquids or exhibit all these qualities at the same time.

The pump body is cylindrical and corresponds, as regards its shape and/or its sizes, to the different diameters of the wells.

The length of the pump body corresponds to the main diameters of the wells, but is at least one meter, which enables to contain leachates or polluted liquids in the order of 4 or 5 liters.

For exemplification purposes, a pump body one meter long and with 80 mm useful diameter should contain 4–5 liters.

The operation pressure of the sleeve valve is determined by the limit pressure ensuring perfect tightness.

The maximum operation pressure of the compressed air in the pump body is smaller by 1.5 to 2 bars than that used in the sleeve valve. Thus, for exemplification purposes, for an 8-bar guaranteed sleeve valve, the operation pressure must not exceed 6–6.5 bars. With a pressure in the order of 6–6.5 bars, the device enables low flow rate pumping, in the order of 0 to 10 $m^3$ per day, which corresponds to most applications. Such a pressure in the pump body enables pumping up liquids over a total pumping up height of approximately 60 to 65 meters, for liquids whose density is close to 1.

In order to protect the compressed air supply pipe of the sleeve valve against possible damages caused by the friction against the wall of the well, three embodiment variations have are foreseen. According to the first one, the pipe is integrated into the body of the pump, according to the second, it is placed along the pump body outside the said, and according to the third embodiment, a protection chute is fastened against the pump body and the pipe is placed inside the chute.

This chute can also receive wires connected to level slaving contacts. These contacts determine a signal that authorises stopping or re-starting the pump, according to the level of liquid in the well.

The presence of a chute also enables insertion of a pipe of 'bubble-to-bubble'-type fluid level detection device.

Stepping several contacts along the pump body enables generating stepped signals supplying the operator with a hydric balance of the well, at the time considered.

The major interest of the pneumatic pumping device according to the invention lies in that it is totally explosion-proof and that, combined with several electrodes implanted corrected at distances defined along the chute or along the pump body, for example every five, ten or twenty centimeters, it also enables obtaining, at any moment, by periodic or continuous reading of these signals, the level and the variations, of the liquid levels in the well or the pit.

DETAILED DESCRIPTION OF THE INVENTION

Figure 2:
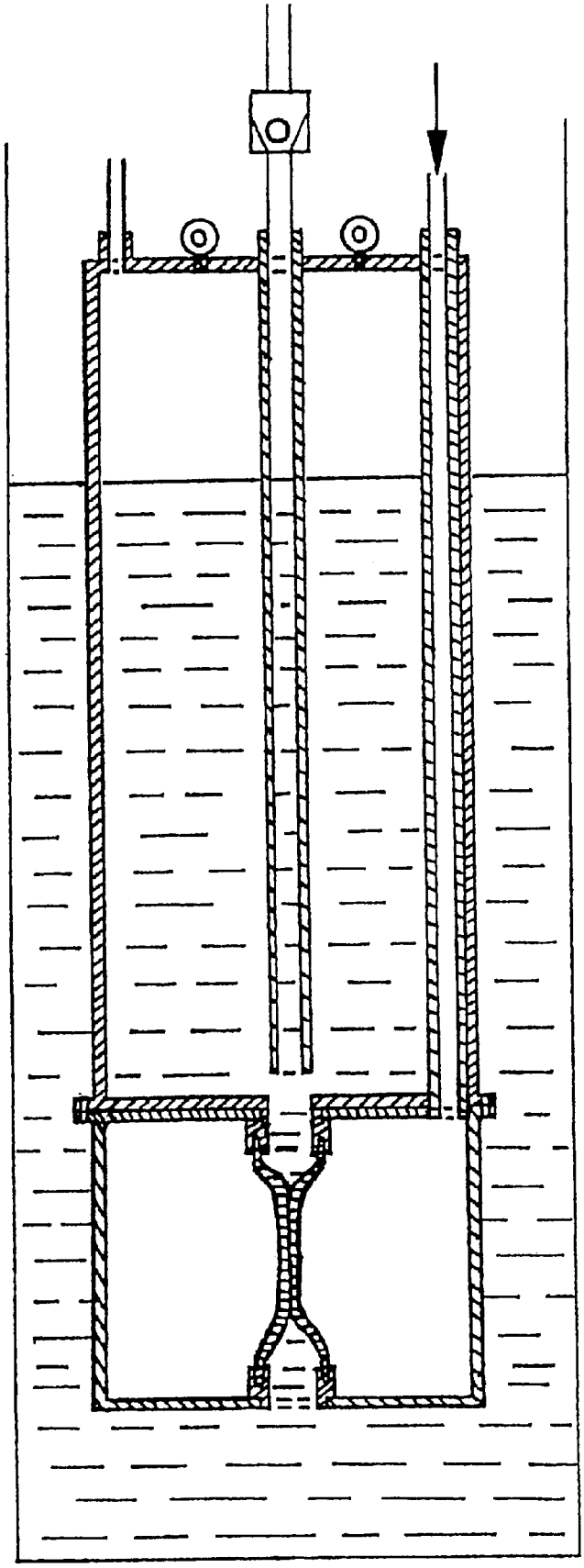
Figure 3:
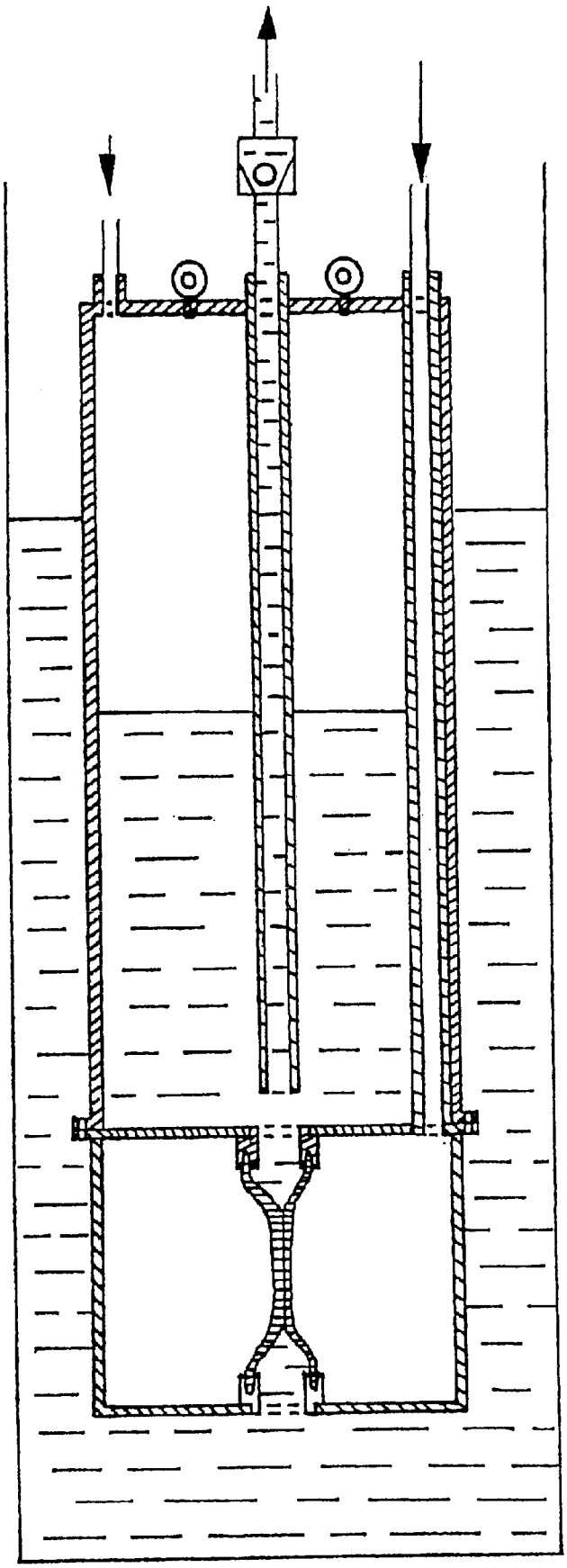
Figure 4:
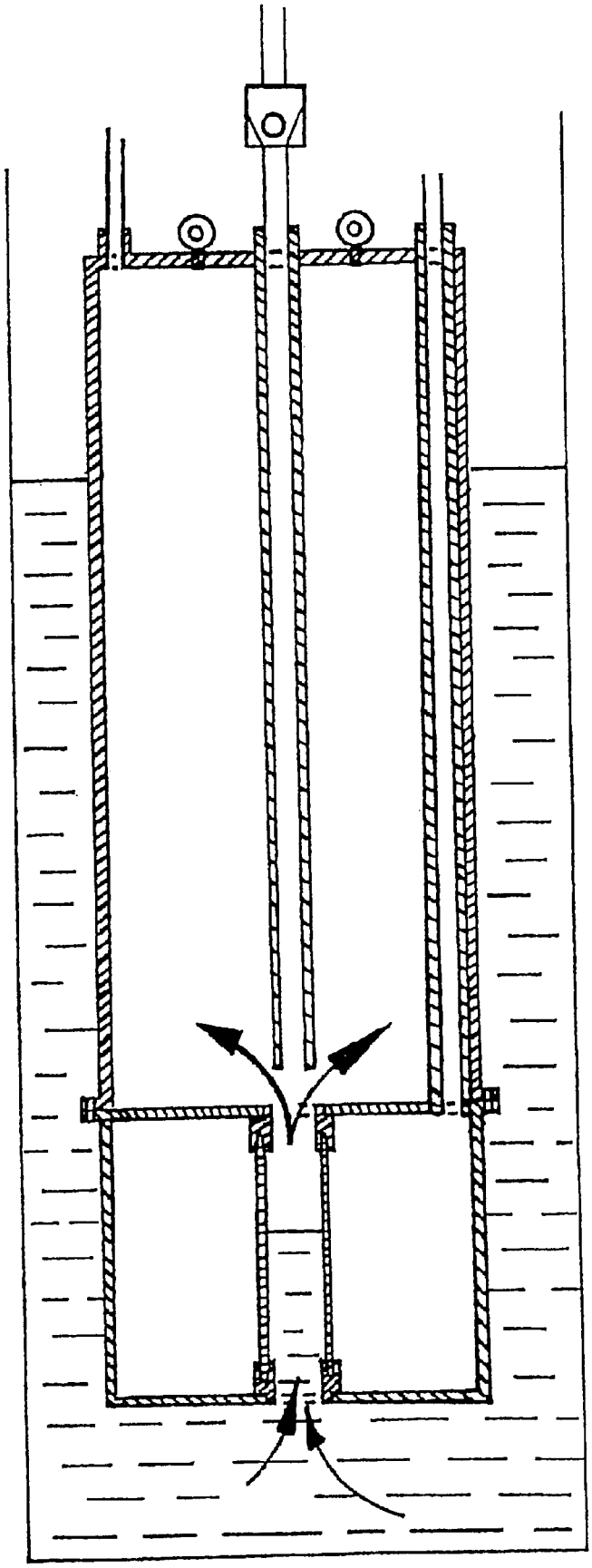

The following description relates to FIGS. 1 to 4 that represent a pumping device ('the pump') according to a preferred embodiment of the invention, in four successive stages of a pumping cycle.

The pump comprises a tubular body 1 making up a pump body and defining a cylindrical main chamber 2 in the upstream 3 and downstream 4 ends of which respectively emerge an inlet orifice 5 and an outlet orifice 6 for the liquid to be pumped.

The pump further comprises a sleeve valve 7 arranged in front of the inlet orifice 5 to control the passage of the liquid to be pumped through the said orifice, means 8 for controlling the opening and closure of the sleeve valve 7 with a compressed gas, a delivery pipe 9 passing through the outlet orifice 6 and extending inside the tubular body over the major part of the length thereof, and means 10 for supplying the main chamber 2 with compressed gas. The delivery pipe is advantageously, but not necessarily, fitted with a return valve 18.

The tubular body 1 is formed by a cylindrical revolution pipe closed at both its ends, the lower upstream end 3 and the upper downstream end 4, respectively with a lower plate 31 and with an upper plate 41, which delineate inside the tubular body 1 the main chamber 2.

The plates 11 and 31 compose the upstream and downstream ends of the secondary chamber, each fitted with a passage opening.

According to the embodiment represented on the figures, the wall of the pump body extends beyond the lower plate 31 in order to constitute as well the external wall of the sleeve valve 7.

The sleeve valve 7 comprises, in addition to the external wall, a plate 11 delineating with the external wall and with the lower plate 31 of the main go chamber 2, a secondary chamber 12. The plate 11 is fitted with a passage opening 13 through which the liquid to be pumped enters the valve 7. The liquid then comes out through the lower orifice 5 of the main chamber 2 which fulfils, in the embodiment represented, a double function: passage opening at the outlet of the sleeve valve 7 and inlet orifice of the main chamber 2.

It goes without saying that the sleeve valve can be an individual element with its own tubular body constituting the external wall of the valve and having an upper plate distinct from the plate 31 and fitted with a passage opening making up the outlet of the valve 7. In this embodiment, the diameter of the external wall of the valve may differ from that of the pump body.

The sleeve valve 7 comprises, regardless of its configuration, a sleeve 14 that is elastically ductile and that connects the upstream and downstream openings of the valve, thereby forming a channel through which the liquid to be pumped must flow in order to enter the main chamber 2 of the pump. The sleeve 14 separates, besides, hermetically the channel of the secondary chamber, which surrounds the channel.

The pump body is fitted, in its upper section, with two orifices 15 and 16, through which run two compressed gas supply pipes, referred to as 8 and 10.

The supply pipe 8 is significant of means enabling to control the opening and closure of the sleeve valve 7 with compressed gas, for example compressed air. This pipe 8 is connected by one of its ends to the secondary chamber 12 and by the other end to a generally flexible duct, which in turn, is connected to a compressed gas source. According to the embodiment represented, the pipe 8 runs through the orifice 15 provided in the upper plate 41 of the pump body.

The supply pipe 10 is significant of the means that enable to supply the main chamber 2 with compressed gas. This pipe 10 is connected by one of its ends to the orifice 16 provided in the upper plate 41 of the pump body and by the other end to a generally flexible duct which, in turn, is connected to a compressed gas source. This compressed gas source, for example a compressed air tank, may be the same as that supplying the secondary chamber. It goes without saying that, in such a case, each of the pipes 8 and 10 is connected to the compressed air tank by distinct control means.

The pump body comprises besides two eyelets 17 welded to the upper plate 41 of the pump body, in order to fasten, for example, a chain or a cable through which the pump is operated and maintained in the well.

According to a variation of the embodiment represented, the pump may be fitted with a tripod fastened to the pump body, for example at the same height as the plate 31, by means of a base welded to the pump body. The space formed by the feet of the tripod can be delineated by a mesh grid fastened around the tripod and protecting the sleeve valve from the ingress of plastics or other possible bodies.

The protection mesh grid around the tripod may be composed of a double row of meshes of identical or different sizes.

The diameter of the compressed air and liquid delivery supply pipes depends on the flow rate desired, and the length of its pipes depends on the pumping up height of the liquid in the well.

This device exhibits the following advantages:

The pump is volumetric: i.e. at each cycle, the compressed air repels a volume of liquid equal to the volume contained in the pump body.

The hourly flow rate, determined by a delay system integrated into an electro-pneumatic or pneumatic control device, installed in an appropriate control cabinet, is equal to the number of cycles per hour multiplied by that volume.

This pump has only one mobile and wear part: the elastically ductile sleeve.

Thus pump only uses a compressed gas, such as compressed air, as a power source and is therefore explosion-proof by nature.

According to the conditions of use of the pump, the air pressure in the pump body may vary from one to ten bars.

The failures on this pump are very few in number. To protect the membrane of the sleeve valve as much as possible against wear, a strainer or a grid may be placed in front of the inlet passage opening of the valve.

The pump does not call for any lubrication, or gaskets, or engines, or shutters, or floaters.

The pump is perfectly tight, which prevent from any pollution.

Replacing the ductile membrane is easy.

The price of this pump is small in relation to the other pumps for leachates or polluted liquids.

This pump may carry any type of liquid, including leachates, polluted liquids, sludgy liquids and chloride-loaded liquids.

Chloride deposits in the pump do not prevent it from operating.

The maintenance of the pump is easy and cheap.

Air consumption of compressed air depends on the conditions of use.

The pump operates in a discontinuous fashion and can, thanks to a level slaving device, stop working at a given level of leachates or polluted liquids in the well.

What is claimed is:

1. A pneumatic pumping device of a liquid operating in a discontinuous fashion and immersed, and with compressed gas and that is intended for pumping liquids such as landfill leachates, comprising a tubular body (1) forming a pump body and defining a cylindrical main chamber (2) in the upstream and downstream ends of which respectively emerge an inlet orifice (5) and an outlet orifice (6) for the liquid to be pumped, characterised in that the to pneumatic device comprises a sleeve valve (7) arranged in front of the inlet orifice (5) to control the passage of the liquid to be pumped through the said orifice, means (8) for controlling the opening and closure of the sleeve valve with a compressed gas, a delivery pipe (9) passing through the outlet orifice and extending inside the tubular body over the major part of the length thereof, is and means (10) for supplying the main chamber with compressed gas.

2. A device according to claim 1, characterised in that the tubular body (1) consists essentially of a cylindrical tube closed at both its ends, the upstream end and the downstream end, respectively with a lower plate (31) and an upper plate (41), whereas the space between both these plates forms the main chamber (2) of the pumping device, the inlet orifice of the main chamber is placed in the lower section of the tubular body, considered in the position of use of the device according to the invention and the outlet orifice is arranged in the upper section of the tubular body.

3. A device according to claim 1, characterized in that the material of the tubular body (1), of the pump is selected so that the body can be protected by an anticorrosion coating, preventing oxidations and chloride deposits.

4. A device according to claim 1, characterized in that the inlet orifice (5) of the main chamber is situated in the lower plate of the tubular body and the outlet orifice (6) is situated in the upper plate.

5. A device according to claim 1, characterized in that the sleeve valve (7) is composed of a tubular body forming a secondary chamber in the upstream and downstream ends of which emerge, at each of both ends, at least one opening (13, 5) for the passage of the liquid to be pumped, whereas these passage openings are connected together by an elastically ductile sleeve (14) that constitutes a channel through the liquid to be pumped should flow to enter the main chamber of the pumping device.

6. A device according to claim 1, characterized in that the tubular body (1) of the pump, the plates (31, 41) and the sleeve valve (7) are made of materials resistant to thick matters, polluted liquids, salted liquids and liquids whose temperatures may be higher than 80° C.

7. A device according to claim 1, characterized in that the inlet orifice (5) of the main chamber (2) and the sleeve (14) of the sleeve valve are arranged coaxially with respect to the axis of the tubular body.

8. A device according to claim 1, characterized in that the space (12) surrounding the passage channel of the sleeve valve is connected by a pipe (8) integral with the tubular body, to a compressed gas supply source.

9. A device according to claim 1, characterized in that the delivery pipe (9), the compressed gas supply pipe (10) of the main chamber (2) and the compressed gas supply pipe (15) of the secondary chamber (12), does not protrude form the wall of he pump body.

10. A device according to claim 1, characterized in that at least one of the pipes among the delivery pipe (9), the compressed gas supply pipe (10) of the main chamber (2) and the compressed gas supply pipe (15) of the secondary chamber (12), does not protrude from the wall of the pump body.

* * * * *